US008161991B2

(12) United States Patent
Johnson

(10) Patent No.: US 8,161,991 B2
(45) Date of Patent: Apr. 24, 2012

(54) MULTIPURPOSE CAMPING HAMMOCK

(76) Inventor: Wes Ryland Johnson, Raleigh, NC (US)

( * ) Notice: Subject to any disclaimer, the term of this patent is extended or adjusted under 35 U.S.C. 154(b) by 0 days.

(21) Appl. No.: 11/851,929

(22) Filed: Sep. 7, 2007

(65) Prior Publication Data

US 2009/0065036 A1 Mar. 12, 2009

(51) Int. Cl.
*E04H 15/04* (2006.01)
*E04H 15/30* (2006.01)

(52) U.S. Cl. ..... 135/90; 135/95; 135/96; 5/121

(58) Field of Classification Search ..... 135/90, 135/95, 96; 5/121
See application file for complete search history.

(56) References Cited

U.S. PATENT DOCUMENTS

| | | | | |
|---|---|---|---|---|
| 4,308,883 | A * | 1/1982 | Malone | 135/90 |
| 4,320,542 | A * | 3/1982 | Cohen | 5/121 |
| 4,686,720 | A | 8/1987 | Newell | |
| 4,703,521 | A * | 11/1987 | Asher et al. | 2/69 |
| 4,862,906 | A * | 9/1989 | Jordon | 135/95 |
| 5,655,235 | A | 8/1997 | DeAth | |
| 5,715,552 | A | 2/1998 | DeAth | |
| 6,085,767 | A * | 7/2000 | Maslow | 135/95 |
| 6,347,638 | B1 | 2/2002 | Scott et al. | |
| 6,353,946 | B1 * | 3/2002 | Steiner | 5/121 |
| 7,383,597 | B2 * | 6/2008 | Steiner | 5/121 |
| 2005/0188460 | A1 * | 9/2005 | O'Brien | 5/121 |

FOREIGN PATENT DOCUMENTS

| | | | |
|---|---|---|---|
| DE | 29603038 | U1 * | 6/1997 |
| WO | WO 0204767 | A1 * | 1/2002 |

OTHER PUBLICATIONS

Backpacker Magazine—Shelters Plus: Hammocks, Bivys, and Tarps, http://www.backpacker.com/gear/12462; Jun. 2008, US.

* cited by examiner

*Primary Examiner* — David Dunn
*Assistant Examiner* — Danielle Jackson
(74) *Attorney, Agent, or Firm* — James G. Passé; Passé Intellectual Property, LLC

(57) ABSTRACT

A covered hammock that acts as both a hammock and a ground tent is disclosed which has a plurality of curved support means for keeping the upper fabric off the user and also for supporting the device as a tent when used on the ground.

5 Claims, 2 Drawing Sheets

MULTIPURPOSE CAMPING HAMMOCK

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to covered hammocks. In particular the present invention relates to a hammock that is not only covered but also can be used efficiently as a ground tent.

2. Description of Related Art

For camping and recreational activities there are and continue to be developed many sizes shapes and functions of tents, hammocks and other shelter devices. The shelter devices provide shelter from insects, ground dwelling creatures, and most importantly inclement weather such as rain. By suspending a tent in the form of a hammock above the ground which can be hard, bumpy, wet, cold and/or dirty hammocks provide a potentially more comfortable dry, warm and clean sleeping surface than do tents. Hammocks may be used, given proper fixed supports, in areas that would be difficult or impossible to pitch a tent due to terrain or wet conditions.

On the other hand, hammocks required those fixed supports such as two trees in order to use the hammock. Tents on the other hand with the aid of supporting poles can be set up and while they can be staked into the ground, several self supporting styles means that they can be set up in hard ground or rock where no hammock can be set up.

Many of the existing hammocks with covers are specialized and require use only in specific situations. Other hammocks while usable as a tent do not offer all the protection from the elements and have some problems compared to their use as a hammock. Some of these devices have bulky frames that are not easily moved while others approximate a hanging tent and are difficult to set up, requiring the use of many overhead ropes, stakes and types of pole assemblies to stabilize the hammock. Even further, the impairment of vision while inside the covered hammock, stuffiness, restricted lateral movement, lack of protection from the sun and difficulties with keeping rain out due to inadequate spacing between camper and tent wall are presented by previously made covered hammocks.

In U.S. Pat. No. 4,686,720 to Newell, issued Aug. 18, 1987 there is described a covered hammock with an upper fabric cover and a single arch member. While the hammock works as both a hammock and can be used as a tent the amount or room has in the past been considered insufficient and problems have occurred in keeping water and humidity out of the hammock especially when used on the ground as a tent.

In U.S. Pat. No. 5,655,235 to Death, issued Aug. 12, 1997 and U.S. Pat. No. 5,715,552 to Death issued Feb. 10, 1998 there is described a sheltered hammock with a collapsible spreader bar with a sheltering enclosure. While the Death reference uses an innovative spreader bar design which might be useful in using the design as a tent, the particular support design of supporting the enclosure prevents effective use on the ground of this particular design.

In U.S. Pat. No. 6,347,638 to Scott and issued Feb. 19, 2002 there is described a portable shelter for suspension above the ground. This shelter has a series of support ropes for the walls and floor and 2 horizontal rigid support members which need the support ropes to keep spaced to give a completely open structure during use and thus allowing for improved use in rain conditions. This design however, is very poor for use on the ground because of the need for upper suspension ropes to keep the structure open. In addition the design is extremely heavy compared to most "backpacking" type hammocks and thus not as practical as most hammocks on the market today.

It is clear that any improvement in the design of a backpacker's hammock would be welcome if the design could be useful for both hammock and tent use. The design would need to overcome the difficulties of the previous designs and still be lightweight and resistant to inclement weather.

SUMMARY OF THE INVENTION

The present invention relates to the discovery that a shelter hammock with a tapered design and a support arch positioned toward the wide end and a second support arch positioned essentially at the narrow end is unexpectedly superior in providing uses of the shelter as either a tent or a hammock as well as improved inclement weather protection during rainy conditions and improved comfort of the user when compared with the hammocks of the prior art. It also relates to the discovery of the importance of using collapsible spreader bars to insure that the floor can be tight for uses on the ground.

Accordingly, the shelter device in one embodiment comprises a shelter device useful as a hammock or as a tent comprising:

a) a floor member having a wide end and a narrow end and having attachment cords and cord spreader bars positioned at each end of the floor member for supporting the shelter device;

b) a first arch member positioned towards the wide end and positioned laterally in a vertical position across the lower floor member;

c) a second arch member positioned at the narrow end and positioned laterally in a vertical position across the lower floor member;

d) a lower cover supported by the first and second arch member and attached to the floor member and having a closable entrance; and e) a removable upper cover supported by the first and second arch members in spaced relationship thereto.

As can be seen there are many embodiments and one skilled in the art can modify the teachings and embodiments consistent with the teaching herein. Other benefits and surprising utility of the present invention will be further seen from the description of the invention which follows.

DETAILED DESCRIPTION OF EMBODIMENTS OF THE INVENTION

Figure 1:
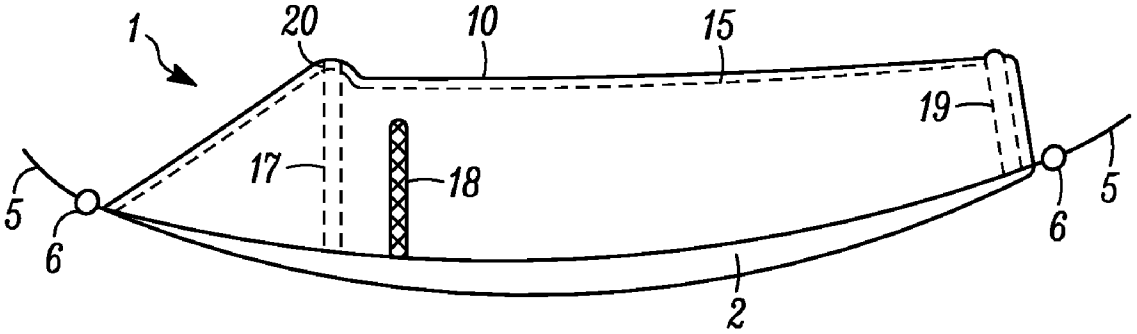
FIG. 1 is a side perspective of an embodiment of the invention.

The present invention relates to the use of 2 supporting arches and multiple end ropes with spreader bars in a sheltered hammock in order to be able to use the shelter device effectively as both a hammock and as a tent. The presence and positioning of the two arches enables the user to have comfortable space in which to move and increases the ability of the user to keep dry during inclement weather conditions. Further the present invention comprises both a tapered design as well as spreader bars to achieve the novel and surprising results as described herein and overcome the drawbacks of previous designs for hammocks.

While this invention is susceptible of embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one as or more than one. The term "plurality", as used herein, is defined as two or more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", "and an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein is to be interpreted as an inclusive or meaning any one or any combination. Therefore, "A, B or C" means "any of the following: A; B; C; A and B; A and C; B and C; A, B and C". An exception to this definition will occur only when a combination of elements, functions, steps or acts are in some way inherently mutually exclusive.

As used herein the term "shelter device" refers to camping shelters including things such as tents which are positioned on the ground and hammocks which are positioned above the ground. In general, the embodiments of the shelter device relate to use for a single person however larger versions of the device could be made for up to 3 people by making the shelter device wider. Tents are normally either free standing or attached to the ground via an attachment means such as stakes. Hammocks are normally attached at both of the sort ends of the hammock to something high enough to get it off the ground and still enter the hammock. Typically trees or a stand are used for such purposes but in general anything that the ends can be attached to is normally sufficient. The present invention shelter device is primarily designed as a hammock but can easily be used as a tent because of its unique design.

The term "floor member" refers to the bottom strip of material that supports the camper in a hammock. The floor member has one end, the head end, wider than the opposite foot end and in one embodiment the floor member is a trapezoidal shape being widest around the shoulders but the head end being wider than the foot end, corresponding roughly to the shape of the human body. In yet another embodiment the head end is wide and tapers down to the foot end. In one embodiment it is possible to apply lateral tension to the floor by attaching a plurality of ropes to the lateral end of the floor parallel to the end. The plurality of ropes connect to a spreader bar which keeps the tension on the ropes and keeps the floor in a spread apart condition. In one embodiment these are the opposite head and foot short ends of the trapezoidal shape. The spreader bar can be solid or can be collapsible to facilitate storage and transportation. In yet another embodiment it can be adjustable in length to facilitate tension on the flooring. In one embodiment the spreader bar is adjustable in length for adjusting tension during use of the shelter of the present invention especially when useful as a tent. One or more ropes or other attachment device leaves the spreader bar (or in an embodiment the ropes merely pass through the spreader bar) for positioning the ropes or a single or other number of ropes from the spreader bar and is used for attachment of the end to a stationary object. For example when used as a hammock the object can be the upper portion of a stand or of tress a certain distance from the ground. When used as a tent the ropes can be attached to stakes or to the lower portion of tress holding the shelter on the ground. The tension on the spreader bars ropes will allow the shelter floor to remain flat during use as either a tent or hammock.

The floor provides the sleeping surface and with its tapered shape embodiment, wider at the shoulders and tapering towards the feet, providing ample room for movement, turning etc within or on the floor member. Typically, tenting material such as rip stop nylon or the like are used for this portion of the shelter of the present invention.

The "first arch member" is positioned around the shoulder area towards the wide end of the floor. It is situated laterally in a vertical position across the floor member. Where there is a widening of the floor this, in one embodiment, would be a possible attachment point. The first arch member in one embodiment is a pole formed into the arch shape desired. The pole can be a one piece or multiple pieces with optional elastic shock cord inside the poles to aid in assembly. The first arch needs only be tall enough to give clearance to the user so in general the height would be about 2 feet to about three and a half feet. It is clear that one skilled in the art could select materials, width and height for an arch based on these teachings. Typically aluminum or other alloy types are used but is in keeping with the skill in the art. Each end of the arch would be positioned in use at or around the long edges of the floor, (for one embodiment see the figures). Support to keep the arch upright is by threading or hanging from the lower cover as described following.

The present invention takes great value in the addition of a second arch positioned toward the narrow end of the floor member. It is also positioned laterally in a vertical position like the first arch. The area chosen for placement of the arch will be in the foot area to insure that the feet do not push on the lower cover and push it into the upper cover thus compromising the rain integrity of the upper cover. Like the first arch each end of the arch would be positioned along the long edges of the floor and support upright in a similar manner. Likewise choice of materials for the second arch would be similar to those of the first arch.

A lower cover is attached to the floor and the first and second arch. The lower cover has a closable entrance and in one embodiment it is closable by Velcro or a zipper. In another embodiment the opening is a lateral inverted u-shaped zipper entrance. In one embodiment the bottom portion of the lower cover is completely sewn or otherwise attached to the floor to make a sealed enclosure. The lower cover is attached to the arches and holds them upright by an attaching means. In one embodiment the attaching means are loops in the lower cover which the arches can be run through. The lower cover can be made of any of those materials normally used for manufacture of tents and hammocks. For example the lower cover can be made of rip stop nylon, women material such as Dacron mosquito net, or a waterproof or resistant material. In one embodiment the lower cover is a mixture of materials for example where the upper portion is a woven and the lower portion a waterproof material. The cover forms a lateral arch enclosing the occupant. The sides extend from the top obliquely downward in all directions until they meet with the edges of the floor. The non-women fabric choice provides visibility and ventilation while a rainproof type material can serve as a buffer against ran that might blow against the shelter during a storm. The arch design provides the maximum internal space and ventilation for the occupant. This is achieved to a maximum due to the use of the first and second arch position toward the shoulders and the feet respectively.

A removable upper cover that acts as a rain cover/fly/tarp is supported by placement over the first and second arch members so that it is in spaced relationship between the upper and lower covers. It can be as large as the lower cover or only cover a portion of the lower cover. It is well known in the art to keep a rain cover spaced in order to prevent leakage of rain into the tent or hammock. The upper cover can have a matching entrance to the entrance in the lower cover making entry easy when the fly is in place. Since the upper cover acts as a rain cover it is designed to be removable during the shelters use so that where there are windows in the lower cover one can see the stars or whatever else is outside. The upper cover can be made of the normal rain fly materials such as rip stop nylon and attached to the floor or lower portion only at the edge portions of the material. The occupant may open the cover in position over the lower cover during inclement weather and secure it in place by selectively placed fasteners. In one embodiment the upper cover may be rolled up and stared near the spreader bar.

An optional sun visor could also be attached at any convenient portion so that any windows or openings or entrances are shielded from direct effects of sunshine. The sun visor could be either permanently attached to any of the pieces of the shelter or be a removable item. One skilled in the art could easily design such a visor from the teaching herein and what is known in the art. In one embodiment the sun visor is attachable to the first arch member. It can be in the shape of an oval rectangle or any other selected shape that fits the parameters over the upper cover.

Now referring to the drawings, FIG. 1 is a side view perspective of an embodiment of the invention with a complete rain fly in place. The shelter device 1 comprises the floor 2 for positioning the sleeping camper. Ropes 5 shown from the side as one rope, can attached to an elevated object to used the shelter as a hammock or to ground stakes or the like for use as a tent. The ropes 5 are kept in spaced relationship by use of a spreader bar which the ropes can be attached to floor 2 threaded or attached to the spreader bar 6 before attachment to the desired object. This spreader bar can be solid or can be adjustable in length or can be collapsible. When adjustable it is normally adjusted such that tension is place on the floor which keeps it taught. By collapsible is meant that it can come apart into two or more pieces which fit together or can literally be pieces of various diameters which collapse into one another.

The upper cover 10 which acts as a rain fly is shown as completely covering lower cover 15 which is hidden from view in this embodiment and shown as a dashed line. The lower cover 15 acts as the barrier from wind insects and the like and is attached to the floor 2 to make a complete enclosure. A zippered entrance 18 to the upper cover is shown that will allow access to the lower cover 15 if desired. The upper cover 10 is kept in spaced 20 relationships by use of the two arched supports 17 and 19 shown positioned beneath the upper cover and over the lower cover.

Figure 2:
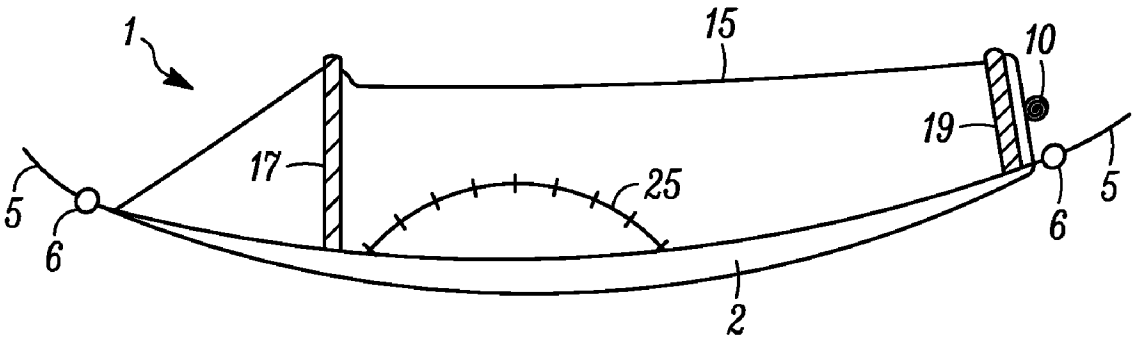
FIG. 2 is a side perspective of an embodiment with the outer cover rolled up and out of the way.

FIG. 2 is a side view perspective of the shelter 1 of the present invention with the upper cover 10 removed and rolled up and positioned at the narrow end of the shelter 1 to show more detail of this embodiment. In this view one can see the arches 17 and 19 positioned over the lower cover 15. The lower cover 15 is supported by attachment in this embodiment to the arches 17 and 19. The lower cover is also shown with a zippered entrance 25 which allows entry and then closure of the entry way into the shelter. In this view the upper cover is a solid material such as waterproof cloth or rip stop nylon.

Figure 3:
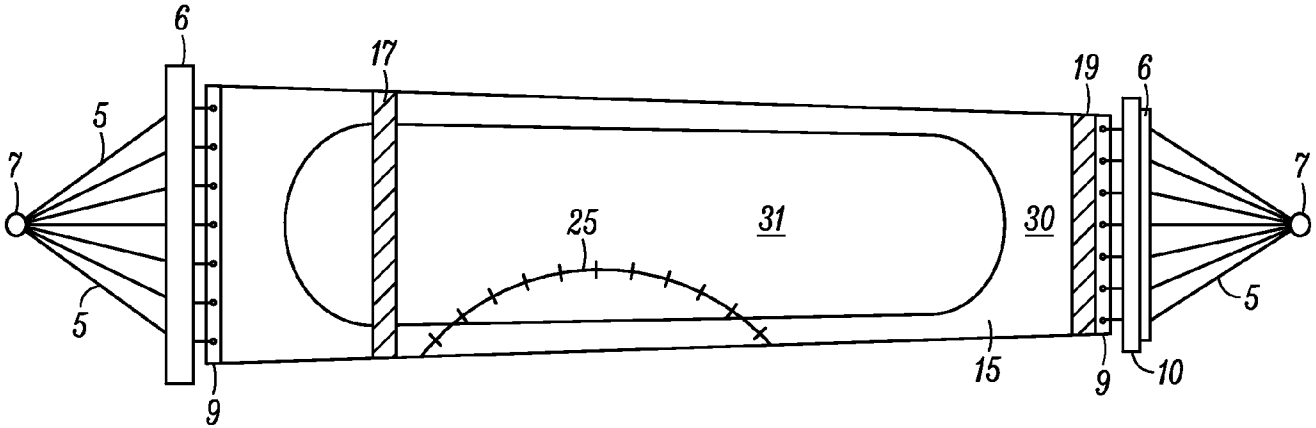
FIG. 3 is a top perspective of an embodiment showing the non-woven top.

FIG. 3 is a top perspective of an embodiment similar to FIG. 2. More detail can be seen in this perspective. The lower cover 15 in this perspective is made of two different materials one portion comprises a non-woven top portion 31 while there is also a waterproof bottom portion 30. The support arches 17 and 19 can be seen from the top as can the entrance zipper 25. This view afford a better look at the plurality of ropes 5 where they are attached to the end of the floor 9 and where in this embodiment the pass through the spreader bar 6. In this view, the ropes 5 are gathered together at support ring 7. Support ring 7 can be used to attach the shelter to a tree, a support cradle or used to stake the shelter down to the ground with stakes or otherwise attach the shelter to the ground. The upper cover 10 is shown from the top rolled up and sitting on top of one of the spreader bars 6.

Figure 4:
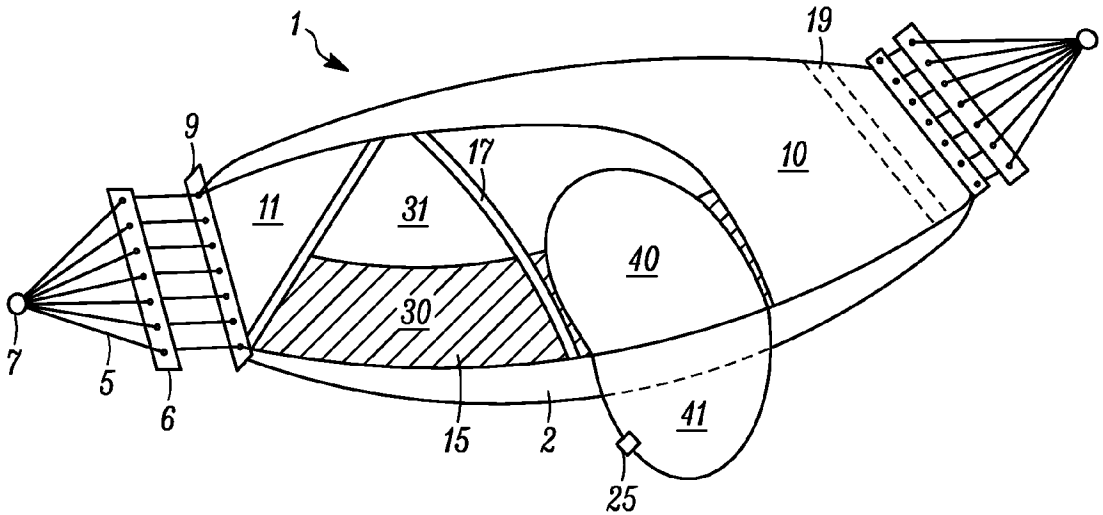
FIG. 4 is a perspective view of an embodiment showing the upper cover pulled back and the entrance open.

FIG. 4 is a perspective of the present invention. In this perspective the zipper 25 is open creating flap 41 and showing opening 40 into the interior of the shelter 1. The upper cover 10 is shown as partially covering the lower cover 15 and one can see the inside surface 11 of the upper cover 10 in this view. Arch support 19 is hidden between the upper cover 10 and lower cover 15 while arch support 17 can be clearly seen in-between the two covers 10 and 15. This view also has attachment rings 70 to attach to a support means. One skilled in the art could easily substitute other attachment means for attaching to a support.

What is claimed is:

1. A hammock comprising:

a) a floor member having a -first end and a second end and having attachment cords and cord spreader bars positioned at each end of the floor member for supporting the shelter device;

b) arch support consisting of:

i. a first arch member positioned in spaced relationship to the first end and positioned laterally in a vertical position across the floor member;

ii. a second arch member positioned at the second end in an essentially non-spaced relationship to the second end and positioned laterally in a vertical position across the floor member;

c) a lower cover supported by the first and second arch member and attached to the floor member and having a closable entrance;

d) a removable upper cover supported by the first and second arch members in spaced relationship to the lower cover; and e) a means for suspending the hammock off the ground;

wherein each arch member is kept upright by threading or hanging the member from the lower cover.

2. A hammock according to claim 1 wherein the entrance is a lateral inverted u-shaped zipper entrance.

3. A hammock according to claim 1 wherein the lower cover comprises a non-woven top portion and a waterproof bottom portion.

4. A hammock according to claim 1 wherein the upper cover has a closable entrance.

5. A hammock according to claim 1 wherein ropes are attached to an attachment means for attaching the shelter to a supporting means.

* * * * *